US005526944A

United States Patent [19]

Merl

[11] Patent Number: 5,526,944

[45] Date of Patent: Jun. 18, 1996

[54] BALANCED INVENTORY/FACING CONSTRUCTION

[76] Inventor: Milton J. Merl, 50 Wilcox Rd., Stonington, Conn. 06830

[21] Appl. No.: 227,538

[22] Filed: Apr. 14, 1994

[51] Int. Cl.[6] ..... A47F 5/08; A47F 5/00; A47B 9/00; A47B 3/00

[52] U.S. Cl. ..... 211/87; 211/90; 211/103; 211/104; 211/86; 211/96; 108/108; 108/162

[58] Field of Search ..... 211/87, 187, 90, 211/103, 104, 86, 96; 108/108, 162

[56] References Cited

U.S. PATENT DOCUMENTS

| | | | |
|---|---|---|---|
| 3,288,544 | 11/1966 | Knecht | 211/86 X |
| 5,038,689 | 8/1991 | Duffy | 211/40 |
| 5,058,846 | 10/1991 | Close | 248/292.1 |
| 5,088,607 | 2/1992 | Risafi et al. | 211/187 X |
| 5,224,677 | 7/1993 | Close | 211/104 X |

*Primary Examiner*—Leslie A. Braun
*Assistant Examiner*—Brian J. Hamilla
*Attorney, Agent, or Firm*—Schweitzer Cornman & Gross

[57] ABSTRACT

An inventory/facing construction currently available gondola which allows it to accommodate faster moving inventory without changing the desired planogrammed facings. A horizonal shelf carries symmetrical anchors at each rear end. A three-way arm has one arm pivotally secured to a forward finger, a second arm retaining; a counter balance spring between the second arm and an upper rear finger of the anchor, and a third arm extending diagonally upwardly pivotally secured to front anchors at each front end of the shelf. The front anchors support a vertical panel between the standards, forming a smaller version of a gondola upright, peg board construction, and supported desired shelving and facings. A bar is pivotally secured to the arms and anchors.

The front anchors define a cam surface which engages a cam follower at the forward end of the horizonal shelf causing the panel to move its substantially full horizonal extent as soon as possible and then to drop vertically to its full extent thereafter. The arms and bar form a torsion bar to insure proper positioning of the panel. The facing shelving occupies about one-quarter of the volume above the gondola base, and the inventory storage behind occupies about three-quarters of the volume.

4 Claims, 6 Drawing Sheets

BALANCED INVENTORY/FACING CONSTRUCTION

This invention relates to gondola merchandising, and more particularly to an improved balanced inventory/facing construction for use in currently available gondolas.

BACKGROUND AND SUMMARY OF THE INVENTION

The majority of inventory in today's stores are carried in gondola constructions. Gondola merchandising has changed little over the years. Generally there is a floor platform with a vertical upright pegboard. On the borders of the gondolas there are vertical weight-supporting uprights having a plurality of vertically aligned slots. The uprights, via the vertical slots, carry shelving and other inserts in or on which merchandise is placed. The pegboard carries some weight but it is minor in comparison to that carried by the uprights.

There is a constant demand for the self-service food and non-food packaged goods industry retailers to increase their efficiency. Add to this the ever-expanding lines of products designed to attract more consumers, and which constantly fight for greater shelf space. This has all resulted in a greater segmentation of sales per individual retail unit of product, or SKU.

Since some products sell better than others, there is a tendency to under-inventory fast moving products, resulting in costly, shorter reorder cycles to maintain proper inventory. There is not enough gondola space available to keep top inventory items in open stock, and the space has to be frequently serviced. At the same time slower moving items tend to stay on the shelves longer, occupying more space relative to their revenue contribution. All this activity has resulted in an extremely inefficient environment, both from labor, warehousing, and inventory management perspectives.

The current gondola merchandising system is outdated in its ability to inventory or display products in volume that match their turns. Accordingly, key sellers in the category tend to be depleted while slow sellers tend to be over inventoried. The current "solution" necessitates frequent ordering and stocking—a very costly solution. Typically a 40% increase in financing is required to carry double the amount of inventory of fast moving products upon which reorder cycles are determined.

As a result there is a need to plan or planogram gondola shelves more efficiently. This should result in creating a method of controlling inventory regardless of the product movement. While it is possible to compensate for key sellers by providing more selling volume (multiple facings), in reality, most stores are not large enough to accept a vast number of multiple facings of fast movers to, in effect, balance out the whole product category. This is a particular problem for supermarkets and self-service merchandising outlets that sell primarily small products and multiple stock keeping units or (SKU). An SKU can be any and all different products based on size, configuration, contents, etc.

Thus, you can have one product being presented in ten or twelve different forms. For example, aspirin can be divided into four different pain different chemistries, and then into powder, pill, capsule, gel, etc. Then there could be nighttime formula, morning formula, middle of the day formula, or baby formula. Aspirin can also go into products for menstrual cramps, headaches, or arthritis. All could be in different sizes. Thus, the permutations can be enormous. There might be over a hundred different SKUs for a single product in its various forms.

With present state of the art gondolas, there is just not enough space in the average store to display or stock adequately balanced inventories. What one ends up with now is an overstock of slow moving items and an understock of fast moving items, all because the gondola shelves are consistently uniform in size and depth.

OBJECTS AND ADVANTAGES OF THE PRESENT INVENTION

An object of the present invention is to develop a balanced inventory/facing construction to accommodate the current number of all SKU facings and more inventory of the fast moving SKUs.

Another object of the present invention is to provide an inventory/facing construction that divides the gondola into two cubic volumes, defining and separating product presentation volume from inventory volume.

Still yet another object of the present invention is to provide an improved construction which provides the facings to display all of the SKUs which is to sell, and provides for immediate, approximate inventory of volume for the fast movers.

Still yet a further object of the present invention is to provide a construction which can be secured to the standard vertical uprights of a standard store gondola.

Still yet a further object of the present invention is to provide a construction which divides the typical shelving area into two areas, one to accommodate inventory and one to accommodate facings.

A feature of the construction is the ability to use the facings area to duplicate the typical gondola construction so as to accommodate the standard constructions used to support and display the average facing one would normally see in a gondola, but spaced significantly forwarding from the pegboard wall of the gondola.

Still yet another object of the invention is to provide a construction which will provide inventory storage exactly at the location of the facings and directly there behind, and yet allow ease of access to the inventory area.

Yet another object of the present invention is to provide a construction which allows the merchandiser to organize his or her product according to sales opportunity as opposed to product variety thus changing the way in which the consumer shops, altering sales toward new and more profitable products.

Still yet another object of the present invention is to provide a construction which will lower management labor and increase the selling turns of the facings.

Still yet another object of the present invention is to provide a construction which will cut down on the number of reorder cycles.

Still yet another object of the present invention is to provide an improved balanced inventory/facing construction which will be simple and easy to fabricate and yet be economical to a high degree in use.

BRIEF DESCRIPTION OF THE PRESENT INVENTION

The invention consists of a shelving unit which hooks into the vertical uprights of a typical gondola. There is shelving which replaces the shelving of the gondola or shelving that would normally be attached to it, with hooks to engage the slots in the vertical uprights. At the rear of the shelving are symmetrically disposed rear anchors with an upper rear finger and forward finger.

Pivotally secured to the forward finger is the first arm of a three way arm. The center arm has a hole which via a hole in the upper rear finger engages a counter balance which in the case of the present construction is a spring. At the front of the shelving are oppositely disposed, moveable front anchors, consisting of a side cam portion which engages a cam follower rotatable secured at the front of the side wall of the shelving. It carries an upper rear finger which is pivotally connected to the third arm of the three way arm. The forward portion of the front anchors simulate the vertical uprights of the gondola and are vertical standards with vertical slots. Placed therebetween is a typical pegboard so that the front looks like the gondola construction only in reduced height. A bar is positioned between the tops of the front anchors and secured to the three-way arms forming a torsion bar to insure that the arms remain in proper spaced alignment during their movement.

By pulling at the front anchors, the three-way arm begins to rotate in a clockwise direction. The front anchors, following the cam follower, first move substantially to their horizonal or forward position. Then the anchors move downwardly the full vertical travel to expose all the cubic storage area behind the panel. Because of the counterbalance and torsion, the panel can easily be moved down and up in the well known fashion, with panel remaining in horizontal/vertical alignment despite uneven loading.

Thus, inventory can be stored behind the panel, the inventory being mostly for the fast moving items while the slow moving items remain in their facing position available for access by the consumer. When the consumer purchases the faster moving item, a stock clerk simply pulls down the front panel takes the fast moving inventory and replaces it in the facings.

For a more complete understanding of the above and other features and advantages of the invention, reference should be made to the following detailed description of a preferred embodiment of the invention and to the accompanying drawings.

BRIEF DESCRIPTION OF THE DRAWINGS

Other objects and advantages of the present invention will become apparent when taken in relation with the accompanying drawings in which.

DETAILED DESCRIPTION OF THE DRAWINGS

Figure 1:
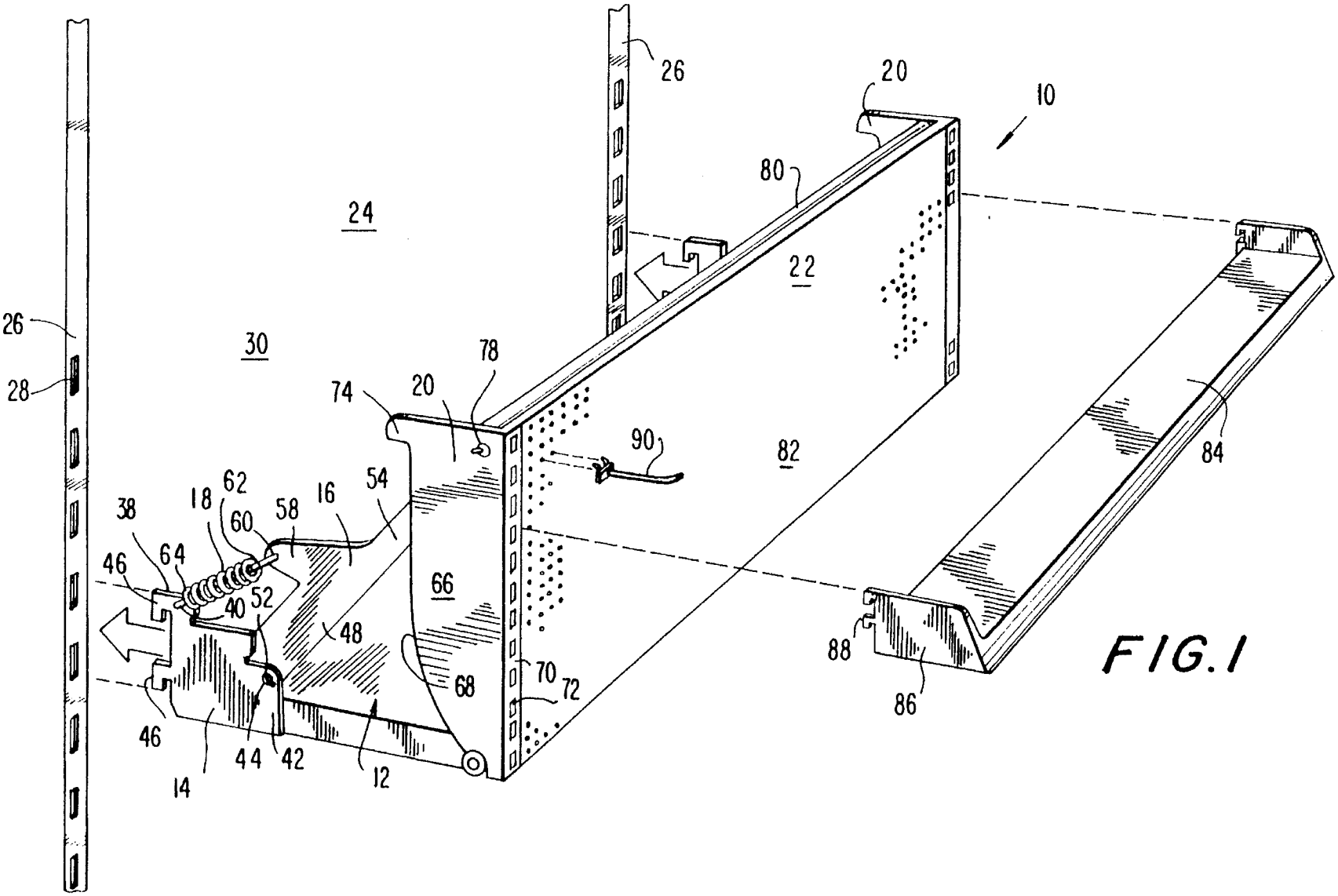
FIG. 1 a front perspective view, partially exploded view of my balance inventory/facing construction embodying my new inventory.

Turning in detail to the drawings, and more particularly to FIG. 1, there is shown an inventory/facing construction 10 broadly comprising a shelf 12 to which are secured rear anchors 14. The anchors carry a three-way arm 16 via a pivot and counterbalance spring 18, the forward end of the arm being secured to front anchors 20. The anchors carry a panel 22. The whole unit is detachably secured to a typical gondola 24 comprising vertical uprights 26 with a plurality of vertical slots 28 and positioned therebetween, a pegboard 30.

The shelving 12 is defined by a sidewall 32, a topwall 34 (FIG. 2), and a frontwall 36.

Figure 5:
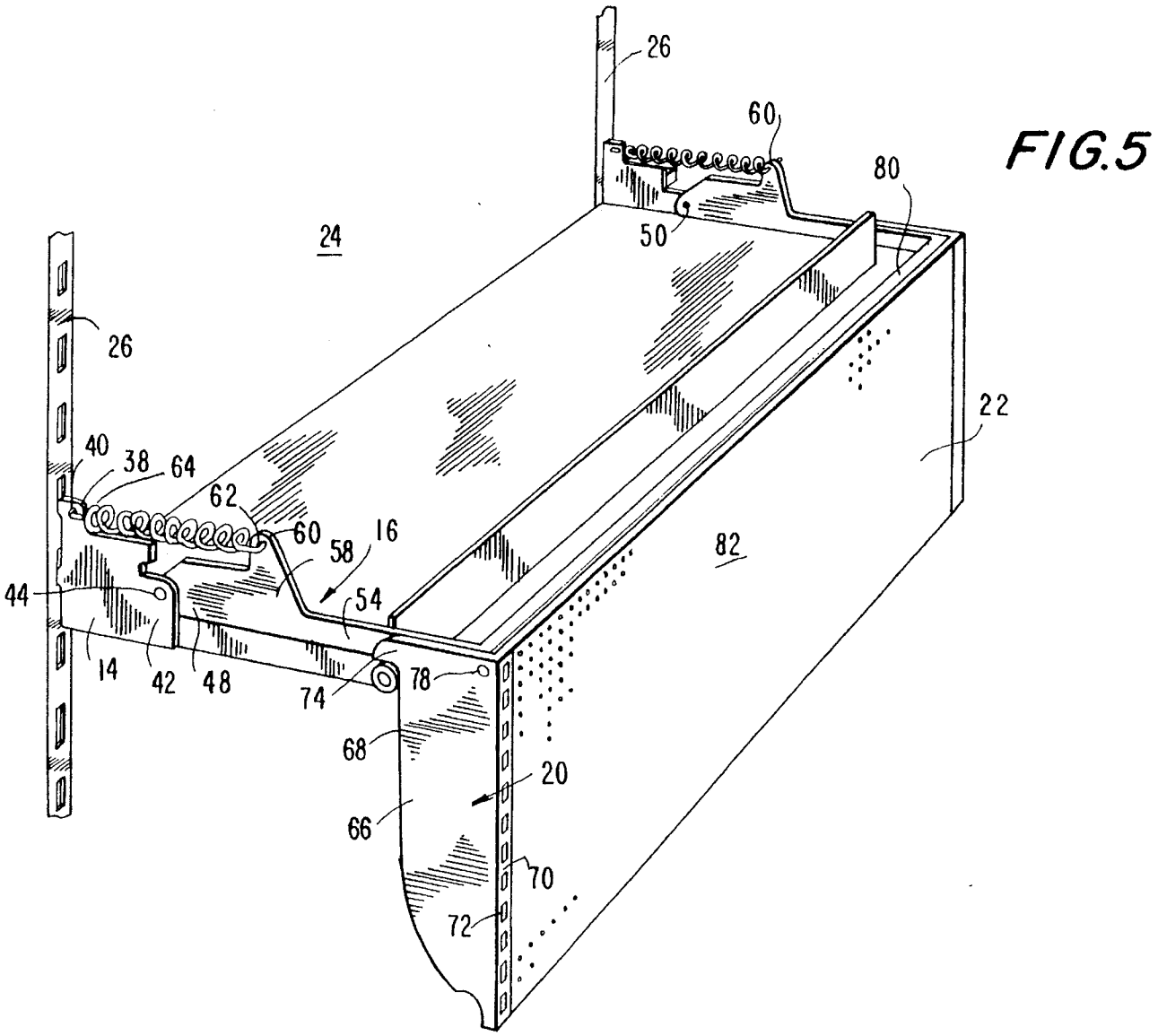
FIG. 5 is a view similar to FIG. 3, but showing the panel in a fully depressed position.

The rear anchors 14 (FIGS. 1, 5) include an upper rear finger 38 in which is defined a hole 40. The anchor also includes a forward finger 42 in which is defined another hole 44. Extending rearwardly from the anchor are hooks 46 designed to engage the gondola vertical upright 26, slots 28.

The three-way arm 16 is essentially T shaped but with the legs slightly skewed. More specifically, the first arm 48 (FIGS. 1, 5) has a mating hole 50 in which is secured a pivot member 52 also engaged by the hole 44 on the forward finger.

The second arm 54 is aligned with the first arm and extends upwardly and forwardly when the panel is in its upright position or extends horizontally when the panel is in its lower position. The arm carries a hole at its distal end.

The third or T-arm 58 carries hole 60.

Counter balance spring 18 has an upper finger 62 which engages the hole 60 and a lower finger 64 which engages the hole 40.

The front anchor 20 has a right angle iron type construction and includes a sidewall cam portion 66 whose rearwall is defined by cam surface 68 which engages a cam follower on the forward end of the self 12. The angle iron portion includes a front standard 70 which is analogous to the vertical uprights 26 of the gondola. The standards carry the plurality of vertical slots 72. The side cam portion terminates at the upper rear portion in a rear finger 74. The front upper portion of the side cam portion has defined therein a hole 76. A pivot member 78 passes through the hole of the side cam portion and the aligned hole of the second arm 54 of the three-way arm 16.

Also positioned and secured to the three-way arm is a bar 80. The arms 16 and bar 80 form a torsion bar.

The panel 22 is made of the typical pegboard 82. As best seen in FIG. 1, the panel end of standard panel 22 and the standards 70 are analogous to the gondola uprights and pegboard 26, 24 and can carry miniaturized versions of front shelving 84 having sidewalls 86 with rearwardly extending hooks 88 engaged in the slots 72 of the standard 70. Also it can carry a pegboard finger 90 engaging the holes in the pegboard in the usual manner.

As can be seen in FIG. 1, the construction 10 is secured to the gondola via hooks 46 being received in slots 28. The key element is the planogram for the front panel. The panel 22 via the shelves 84 and the hooks 90, for example, really carry a smaller version of what might otherwise be secured to the vertical uprights 26 and the pegboard panel 24 of the gondola. The only difference is of course in the high dimension. The area of the shelving 84 and the resulting cubic volume is about one-quarter of the total volume of the gondola. The facings are just as planogrammed presenting the consumer with the complete selection of SKU facings, including the fast moving items and the slow moving items. Thus everything is presented to the consumer.

Figure 2:
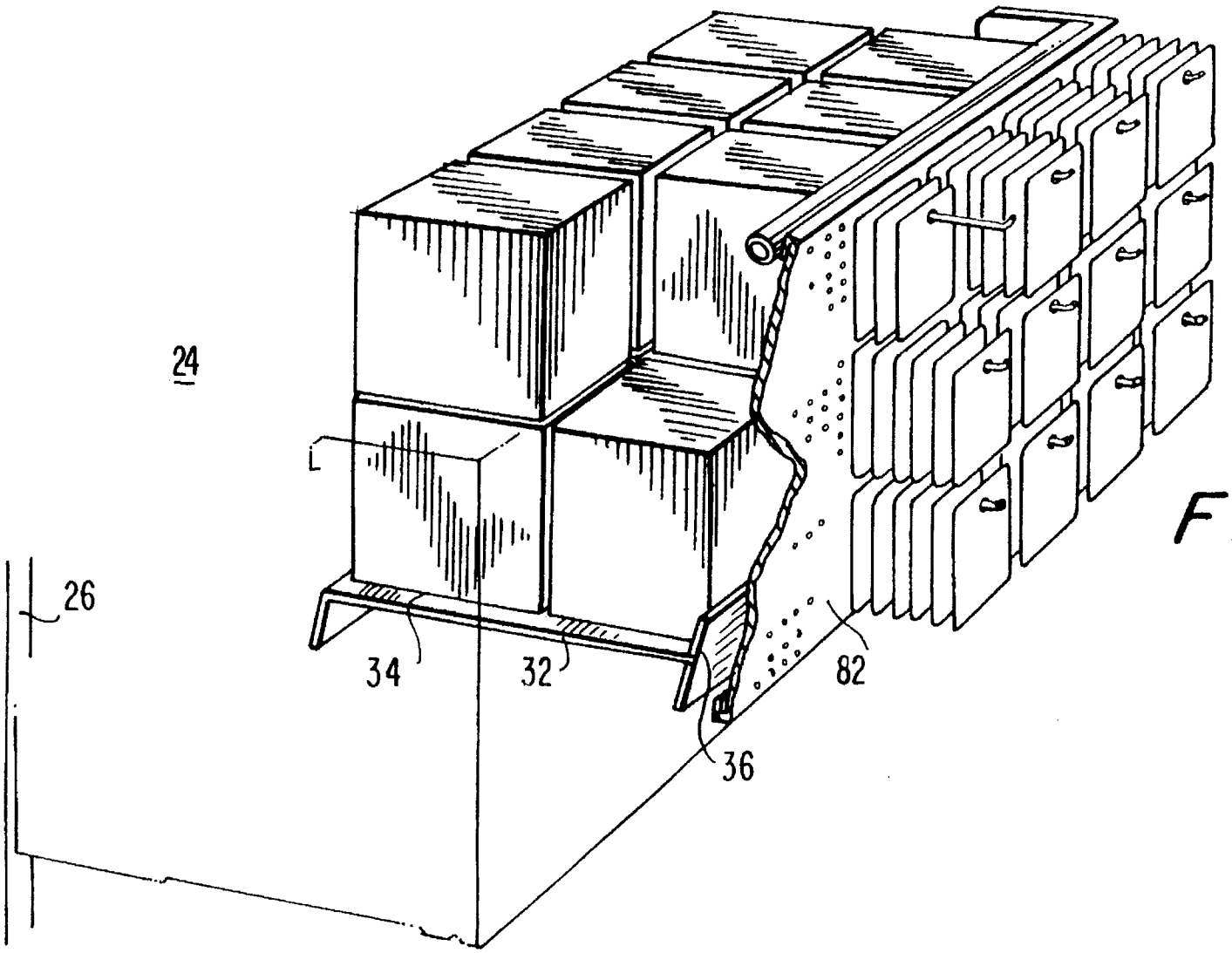
FIG. 2 is a front perspective view, partially cut away showing facings being carried by the panel, and inventory being stored on the shelving behind the facings.
Figure 3:
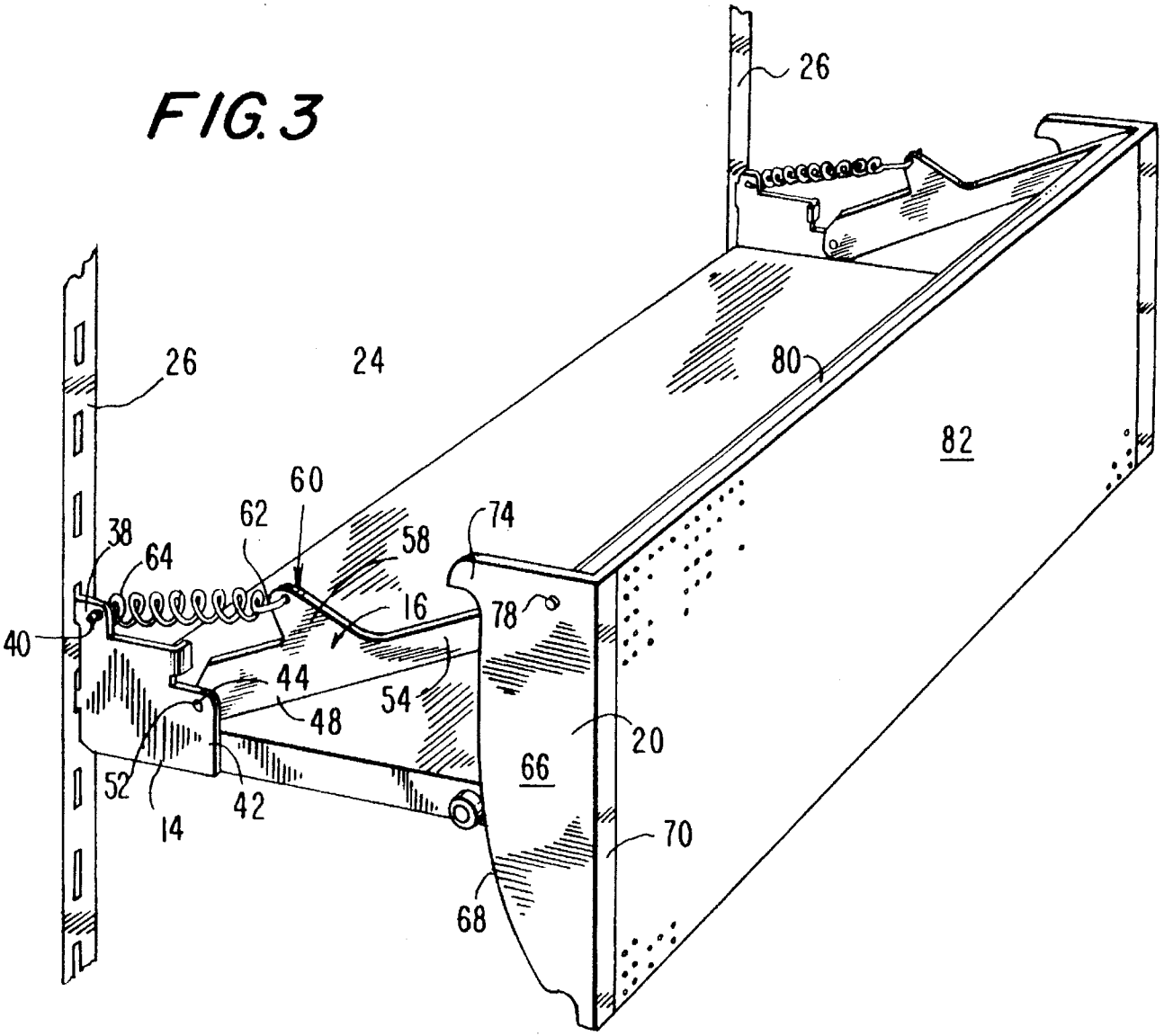
FIG. 3 is a front perspective view, similar to FIG. 1, but showing the construction secured to the vertical uprights of a gondola and with the panel a partially depressed position.
Figure 4:
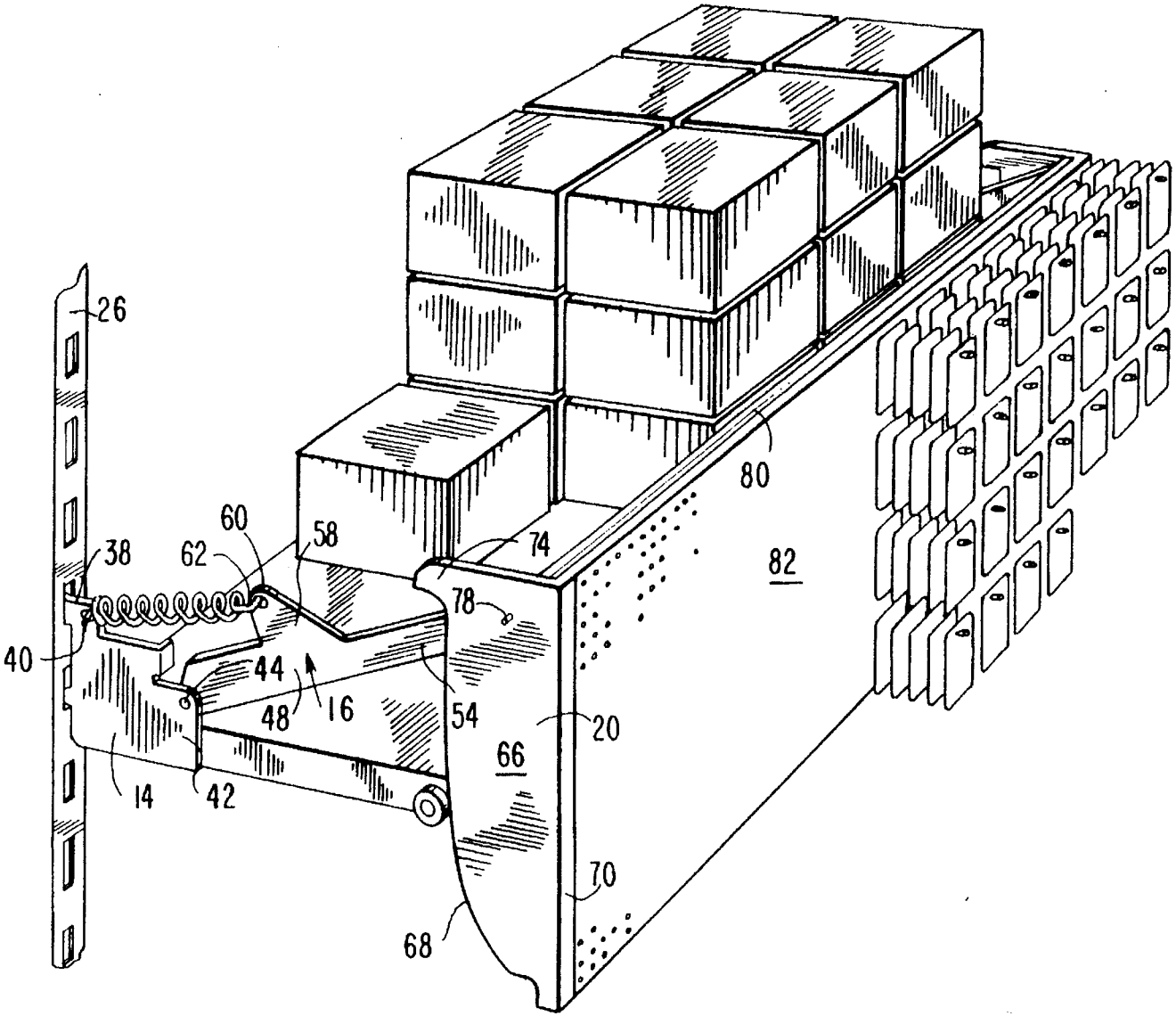
FIG. 4 is a view similar to FIG. 3, but showing the panel carrying facing and showing inventory behind the panel.
Figure 6:
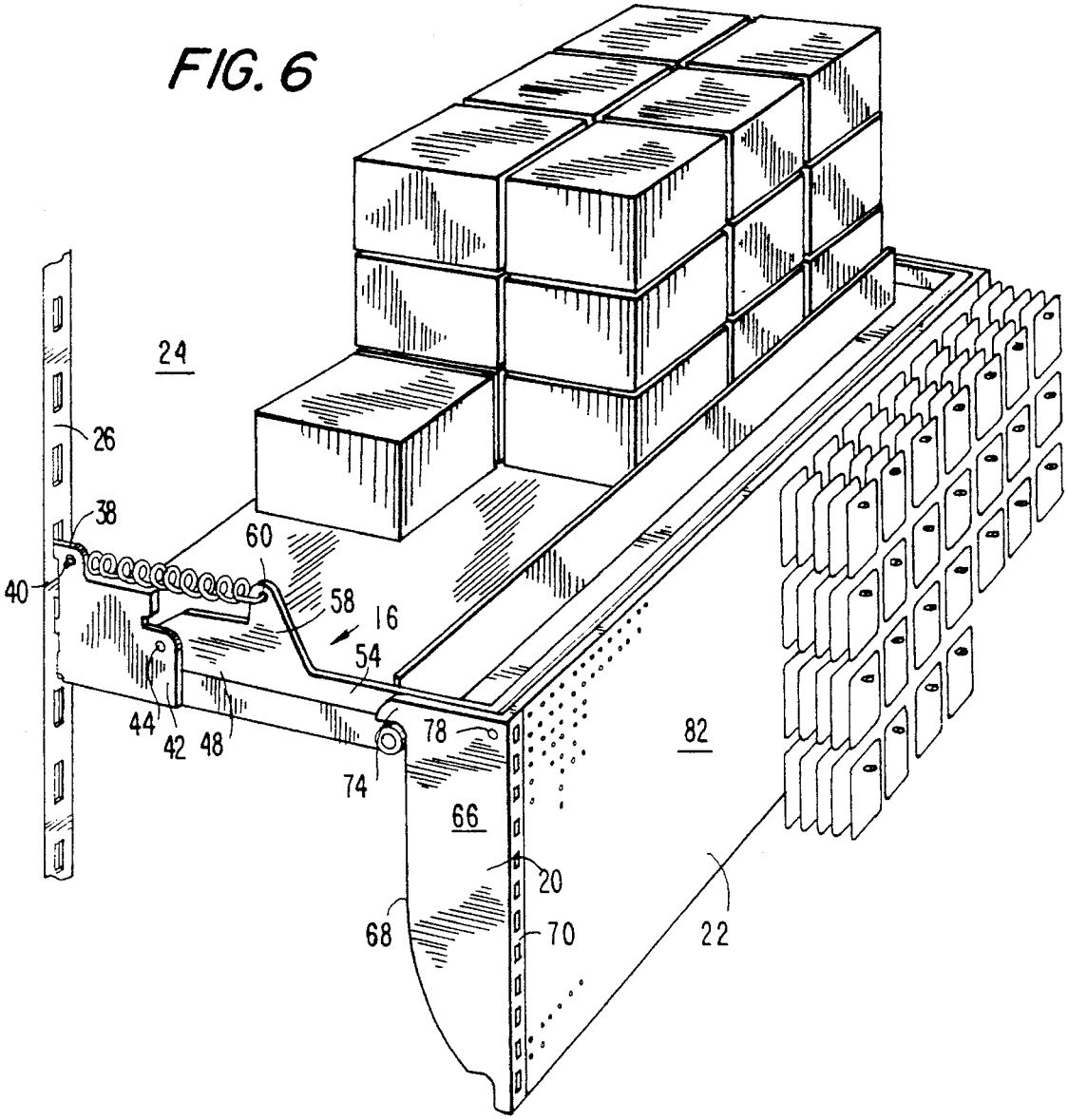
FIG. 6 is a view similar to FIG. 5, but showing the front panel carrying facings and showing inventory on the shelving.

Turning to FIG. 2, the facings are shown with the goods being carried on pegboard fingers. Behind panel 20 and resting on wall 34 of the shelving 12 is the inventory. The inventory may be 90 percent for the fast moving items on the facings and perhaps 10 percent for the slow moving items. The key feature is, as the fast moving items are taken from the facings, practicing the invention allows their rapid replacement. For example, FIG. 4 shows a clerk moving the front panel downwardly to its mid-way position. The clerk continues to move downwardly so that the panel ultimately rests in its lower position (FIGS. 5 and 6), and the inventory is fully exposed. Then the clerk can open up the inventory packaging and replace the fast moving items on the facings in the front of the panel. The clerk then simply moves the panel back up to the upper position. This is easily done because of the counter balance spring 18. The frontwall 36 provides a guide for the placement of the inventory so that it does not interfere with the up and down movement of the panel.

The inventory occupies approximately three-quarters of the space that is normally available in the front of the gondola. Furthermore, the second arm 54 extends all the way to the front of the upper part of the front anchor means. This provides as free as possible access to the inventory as the panel moves up and down and as the anchor means moves away from and closer to the inventory merchandising, especially the upper inventory boxes. Also, more stocking space is made available. The separating bar 80 is positioned at the front for this purpose. The bar 80 and arms 16 function as a torsion bar keeping the panel in proper aligned horizontal/vertical position at all times. Due to uneven loading, the merchandise could be subject to twisting and movement generating motion. The torsion bar keeps the panel in aligned and proper operating position at all times.

Thus, all the traditional problems of stocking and facing have been solved. The facing is complete and is always complete. And the stocking does not require that fast moving inventory items be ordered three, four and five times as often as the slow moving inventory items. Since the labor associated with reordering and moving products through the system, including getting them to the shelves is more expensive then the cost of inventorying product at the proximate locations of the facings costs of selling the item drops.

Furthermore, often times inventory is placed behind facings, but is exposed and looks messy etc. This construction gives a clean fresh and close "comforting" presentation to the purchasing public.

It is obvious that there are certain features to the invention that can be changed. For example, the counter balance could be a piston rather than a spring.

Another feature is the fact that the inventory is where you need it. During the daytime, if inventory has to be located, it sometimes is not that accessible in expensive backroom space. If all the clerk has to do is go to selling location, pull the panel down, load up the facings without having to worry about reorganizing the whole shelf, the savings are axiomatic.

Today, in the days of promotions, it has been stated that if a product does not have promotion associated with its marketing, it is no longer a product. This construction allows promotions to be handled in line, with the regular facings and without changing the whole planogram. There is no necessity to worry about room on the floor of the store to handle a secondary location for promotional bulk. It can simply be stored behind the panels. During the time of the promotion, the amount of inventory can be easily increased without having to change a very, very rigid and expensive and hard to alter planigram. Furthermore, changing the planigram confuses the consumer and lowers the retailer sales.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A balanced inventory/facing construction to increase the efficiency of a gondola merchandising system having a base, vertical uprights secured to the base, and a vertical pegboard between said uprights, the uprights containing a plurality of vertical slots, comprising:

a shelf;

a bracket located at the rear of the shelf having detachable securement means to engage the vertical slots of the gondola uprights;

a vertical panel located forward and above a front edge of said shelf;

a cam follower mounted to said shelf and a cam surface mounted to the vertical panel; and an arm pivotly mounted to said bracket and to said vertical panel to permit said vertical to move vertically downward and forward with respect to said shelf along a path defined by said cam surface to provide exposure and accessibility to said shelf.

2. The invention according to claim 1, further characterized by counter balance means secured to said arm to control movement of said vertical panel from its upper to its lower position.

3. The invention according to claim 2, wherein said vertical panel has a side wall, said cam surface defining the rear surface of said side wall.

4. The invention according to claim 3, further comprising a front bar extending parallel to said vertical panel and pivotally secured to said arm, said bar and said arm acting as a torsion bar.

* * * * *